US007404691B2

(12) United States Patent
Bennett et al.

(10) Patent No.: US 7,404,691 B2
(45) Date of Patent: Jul. 29, 2008

(54) DOWEL BAR ASSEMBLY WITH SNAP FIT SIDE FRAMES

(75) Inventors: Clifford D. Bennett, Fontana, CA (US); Kenneth Lee, Anaheim, CA (US)

(73) Assignee: Dayton Superior Corporation, Dayton, OH (US)

( * ) Notice: Subject to any disclaimer, the term of this patent is extended or adjusted under 35 U.S.C. 154(b) by 0 days.

(21) Appl. No.: 11/940,672

(22) Filed: Nov. 15, 2007

(65) Prior Publication Data

US 2008/0085155 A1 Apr. 10, 2008

Related U.S. Application Data

(62) Division of application No. 11/498,849, filed on Aug. 3, 2006, now Pat. No. 7,314,334.

(51) Int. Cl.
*E01C 11/14* (2006.01)

(52) U.S. Cl. ..... 404/134; 404/60; 404/62; 404/63; 404/135; 404/136

(58) Field of Classification Search ..... 404/60–64, 404/134–136
See application file for complete search history.

(56) References Cited

U.S. PATENT DOCUMENTS

| | | | |
|---|---|---|---|
| 1,545,267 | A | 7/1925 | Marye |
| 2,141,986 | A | 12/1938 | Johnson |
| 2,181,623 | A | 11/1939 | Klein |
| 2,207,168 | A | 7/1940 | Thomas et al. |
| 2,245,972 | A | 6/1941 | Friberg |
| 2,291,157 | A | 7/1942 | Hillberg |
| 2,319,050 | A | 4/1943 | Fischer et al. |
| 2,375,361 | A | 5/1945 | Hillberg |
| 2,552,365 | A | 5/1951 | Bradbury |
| 2,627,793 | A | 2/1953 | White |
| 2,642,789 | A | 6/1953 | Brickman |
| 2,700,329 | A | 1/1955 | Carter |
| 2,768,562 | A | 10/1956 | Godwin |
| 3,033,087 | A | 5/1962 | Hillberg et al. |
| 4,648,739 | A | 3/1987 | Thomsen |
| 5,791,816 | A | 8/1998 | McCallion |
| 5,797,231 | A | 8/1998 | Kramer |
| 5,893,252 | A | 4/1999 | Hardy et al. |
| 6,092,960 | A | 7/2000 | McCallion |
| 6,171,016 | B1 | 1/2001 | Pauls et al. |
| 6,210,070 | B1 | 4/2001 | Shaw et al. |
| 6,447,203 | B1 | 9/2002 | Ruiz et al. |
| 6,832,458 | B2 | 12/2004 | Sander et al. |

*Primary Examiner*—Raymond W Addie
(74) *Attorney, Agent, or Firm*—Thompson Hine LLP

(57) ABSTRACT

An apparatus for combining adjacent concrete slabs including a dowel, an end cap, and a side frame. The end cap has a hood defining a curved channel extending at least partially around a dowel receiving end. The side frame has at least one wire received in the curved channel. Also, an end cap having an integrally formed supporting portion including first and second wire supports for supporting substantially parallel side frame cross wires. Also, an end cap including first and second sleeves positioned along opposing tangents of the outer peripheral surface of the end cap for receiving differing portions of a side frame, and further including a resilient protrusion for receiving a further differing portion of the side frame.

9 Claims, 11 Drawing Sheets

DOWEL BAR ASSEMBLY WITH SNAP FIT SIDE FRAMES

CROSS-REFERENCES TO RELATED APPLICATIONS

This application is a division of U.S. patent application Ser. No. 11/498,849, filed on Aug. 3, 2006, the contents of which are hereby incorporated by reference.

BACKGROUND

The present disclosure relates to concrete construction, and more particularly, but not exclusively, to a dowel bar assembly for connecting adjacent concrete slabs.

The construction of concrete surfaces is commonly accomplished by forming a plurality of adjacent concrete slabs that are separated by expansion joints. In some applications, the concrete slabs may support heavy loads, such as loads exerted by equipment on aircraft runways, taxiways, and parking aprons. The heavy loads that are supported by an individual concrete slab can cause vertical movement of the slab with respect to adjacent slabs. To prevent this damaging movement, the load may be distributed through load bearing dowels that extend between adjacent slabs across expansion joints. These dowels are typically formed from a ductile material, such as steel or fiberglass, which transmits the load and provides additional reinforcing structure. Different techniques exist for installing such dowel bars into a concrete slab.

One of the typical methods for installing dowel bars is to create a dowel bar assembly or apparatus that includes wire side rails for supporting a dowel bar in place prior to the pouring of a concrete slab. Typically, a dowel bar assembly is positioned in an area where two concrete slabs will abut one another. An expansion member may be mounted on the dowel bar assembly, and commonly delineates the respective edges of the concrete slabs. A first concrete slab is then poured along one side of the expansion member, partially covering the dowel bar assembly. A second concrete slab is subsequently poured along a second side of the expansion member, covering the other side of the dowel bar assembly. Therefore the two concrete slabs are separated by an expansion joint and connected together by the dowel bars to help distribute heavy loads across both of the concrete slabs.

Joining the wire side rails to the dowel bar is usually time consuming and costly. The wire rails are usually made of steel and susceptible to corrosion. Often, the corrosion spreads from the wire rails to the dowel bar. Previously, attempts to control the corrosion were made by coating the dowel bar with epoxy. However, commonly the side frame is welded to the epoxy coated dowel bar, and such welds enable corrosion to enter into the dowel bar even with the epoxy coating since the weld areas are not coated. Therefore, one drawback to this method of forming concrete slabs is increased corrosion. In addition, another drawback is the time consuming and costly method of constructing the dowel bar assembly. Furthermore, if the assembly is constructed at a factory, transport and storage of the devices becomes difficult and costly as well.

Therefore, many needs remain in this area of technology.

SUMMARY

In one aspect of the dowel bar assembly there is an apparatus for combining adjacent concrete slabs. The apparatus includes a dowel having an end portion for placement into a concrete slab. The apparatus also includes an end cap having an open end for receiving the dowel end portion. The end cap has a hood extending at least partially around the dowel receiving end of the end cap and positioned transverse to the longitudinal axis of the dowel. The hood defines a curved channel. The apparatus also includes a side frame having at least one wire received in the curved channel of the end cap.

Another aspect of the dowel bar assembly includes an end cap for placing on a dowel. The end cap includes a central portion defining a recess for receiving an end of the dowel, the central portion having a first end, a second open end for receiving the end of the dowel, and an outer surface. The end cap also includes a hood surrounding the defined recess and defining a curved channel around at least a portion of the outer surface of the central portion.

Yet another aspect of the dowel bar assembly includes an end cap for connecting a side frame having a first cross wire and a second cross wire to a dowel. The end cap includes a receiving portion defining an interior area for receiving an end of the dowel. The end cap also includes a supporting portion integrally formed with the receiving portion for supporting the side frame. The supporting portion also includes a first wire support for supporting the first cross wire and a second wire support for supporting the second cross wire. The first and second wire supports are arranged substantially parallel to each other.

A further aspect of the dowel bar assembly includes an end cap for connecting a dowel to a side frame. The end cap includes a tubular central portion having a first end and a second end, where at least one of the ends is an open end for receiving the dowel and the tubular central portion defines an outer peripheral surface. The end cap also includes a first sleeve coupled to the central portion and positioned along a first tangent of the outer peripheral surface of the tubular central portion for receiving a portion of the side frame. In addition, the end cap includes a second sleeve coupled to the central portion and positioned along a second tangent of the outer peripheral surface of the tubular central portion for receiving a differing portion of the side frame. The second tangent is placed on an opposite side of the outer peripheral surface of the tubular central portion from the first tangent. The end cap also includes a resilient protrusion coupled to the central portion for receiving a further differing portion of the side frame.

DETAILED DESCRIPTION

The descriptions contained here are meant to be understood in conjunction with the drawings that have been provided.

Figure 1:
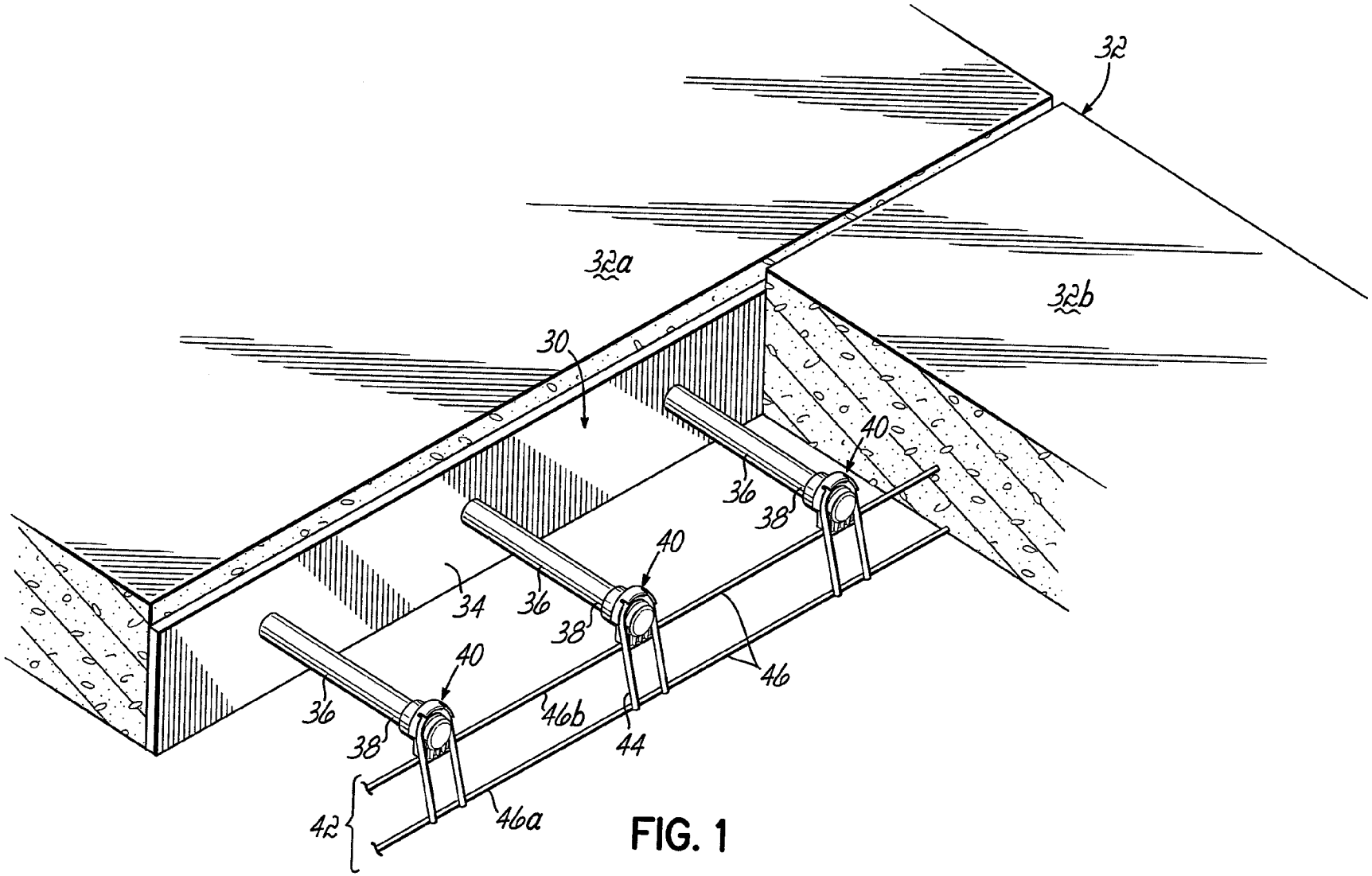
FIG. 1 is a perspective view of an exemplary dowel bar assembly that is partially embedded in abutting concrete slabs.

FIG. 1 illustrates an exemplary dowel bar assembly 30. The dowel bar assembly 30 assists in preventing vertical movement of the concrete slabs 32*a*, 32*b* (collectively designated 32). The concrete slabs 32 abut each other along an expansion member 34 that is placed between the two abutting concrete slabs 32. The expansion member 34 can be made from different materials known by those skilled in the art. For example, in some aspects the expansion member 34 is made of a rubber, cork, fiberglass or various other types of resilient materials. In other aspects, the expansion member 34 is a cardboard or similar type material, such as those used in sidewalk blocks. The expansion member 34 usually either expands or contracts to fill in the area between the abutting concrete slabs 32 during changes in temperature. Extending through the expansion member 34 and out of one of the concrete slabs 32 is at least one dowel bar 36. In the illustrated aspect, three dowel bars 36 are illustrated projecting out of the concrete slab 32. Those skilled in the art will readily recognize that any number of dowel bars 36 can be used as may be required to transfer loads between adjacent concrete slabs. The dowel bars 36 of the illustrated aspect are shown to be cylindrical. In other aspects, however, other shapes can be used. For example, a rod with a square cross-section or even hexagonal cross-section can be used. Similarly, a variety of materials can be used for the dowel bar 36. The dowel bar 36 can be formed from a metal material or a fiberglass material, to name a few. In some aspects, a material having anticorrosion properties, such as a coating of epoxy, may be used to prevent corrosion of the dowel bar 36 due to moisture. FIG. 1 illustrates that the dowel bar 36 extends out of the concrete slab 32*a* into the other concrete slab 32*b* across expansion joint 34. In this way, the concrete slabs 32 are coupled together and a heavy load placed on one of the concrete slabs 32*a*, 32*b* will be spread more uniformly across both concrete slabs 32. Each dowel bar 36 includes an end portion 38 that is sized to receive an end cap 40. Each end cap 40 is placed on the end portion 38 of the dowel bars 36 to provide a structure for coupling a side frame 42 to the dowel bar 36. In the illustrated aspect, the side frame 42 is constructed of two main components. The first component is a curved connection wire 44 that connects to the end cap 40. The other component is a cross wire assembly 46, which combines successive ones of the curved connection wire 44 together. In the illustrated aspect, there are two cross wires 46*a* and 46*b*. FIG. 1 illustrates that the concrete slabs 32 cover the dowel bar assembly 30 after the concrete has been poured and therefore completely buries the dowel bar assembly 30 therein.

Figure 2A:
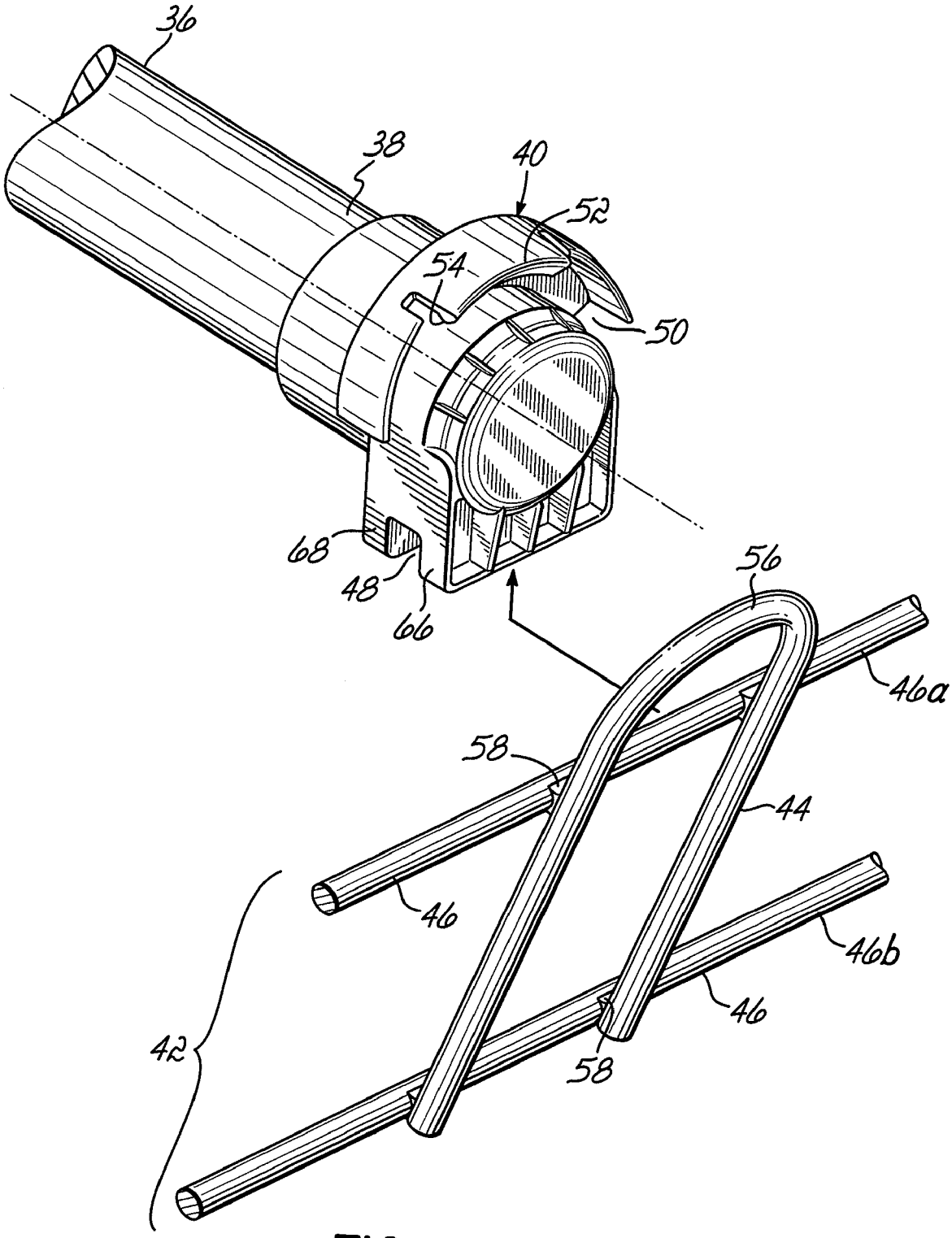
FIG. 2A is a perspective view of one end of the dowel bar assembly of FIG. 1, with the side frame decoupled from the end cap of the assembly.

Referring now to FIG. 2A, the assembly of the side frame 42 into the end cap 40 is illustrated. The end cap 40 includes a channel 48 that runs below the dowel bar 36. The channel 48 is designed to receive the cross wire assembly 46 of the side frame 42. The arrow in FIG. 2A indicates that the channel 48 receives the cross wire assembly 46. The end cap 40 also includes a curved channel 50 that is designed to receive the curved connection wire 44 of the side frame 42. In the illustrated aspect, the curved channel 50 is substantially U-shaped, however, in other aspects the curved channel 50 may have other shapes. The channel 48 is positioned transverse to the longitudinal axis of the dowel bar opposite the curved channel 50. This connection of the curved connection wire 44 and the curved channel 50 is described in more detail hereinbelow with reference to FIGS. 2B and 3B. The curved channel 50 is defined by a hood 52 formed generally around the periphery of the dowel bar 36. The hood 52 includes a resilient protrusion 54 that is used to lockingly engage the curved connection wire 44 when it has been inserted into the curved channel 50. This is illustrated in more detail in FIG. 3B. The side frame 42 includes a curved portion 56 that is received by the curved channel 50 and is surrounded by the hood 52 when it is inserted into the curved channel 50. The cross wires 46 and the curved connection wire 44 are coupled together using welds 58 so that the side frame 42 is provided in a pre-assembled condition.

Figure 2B:
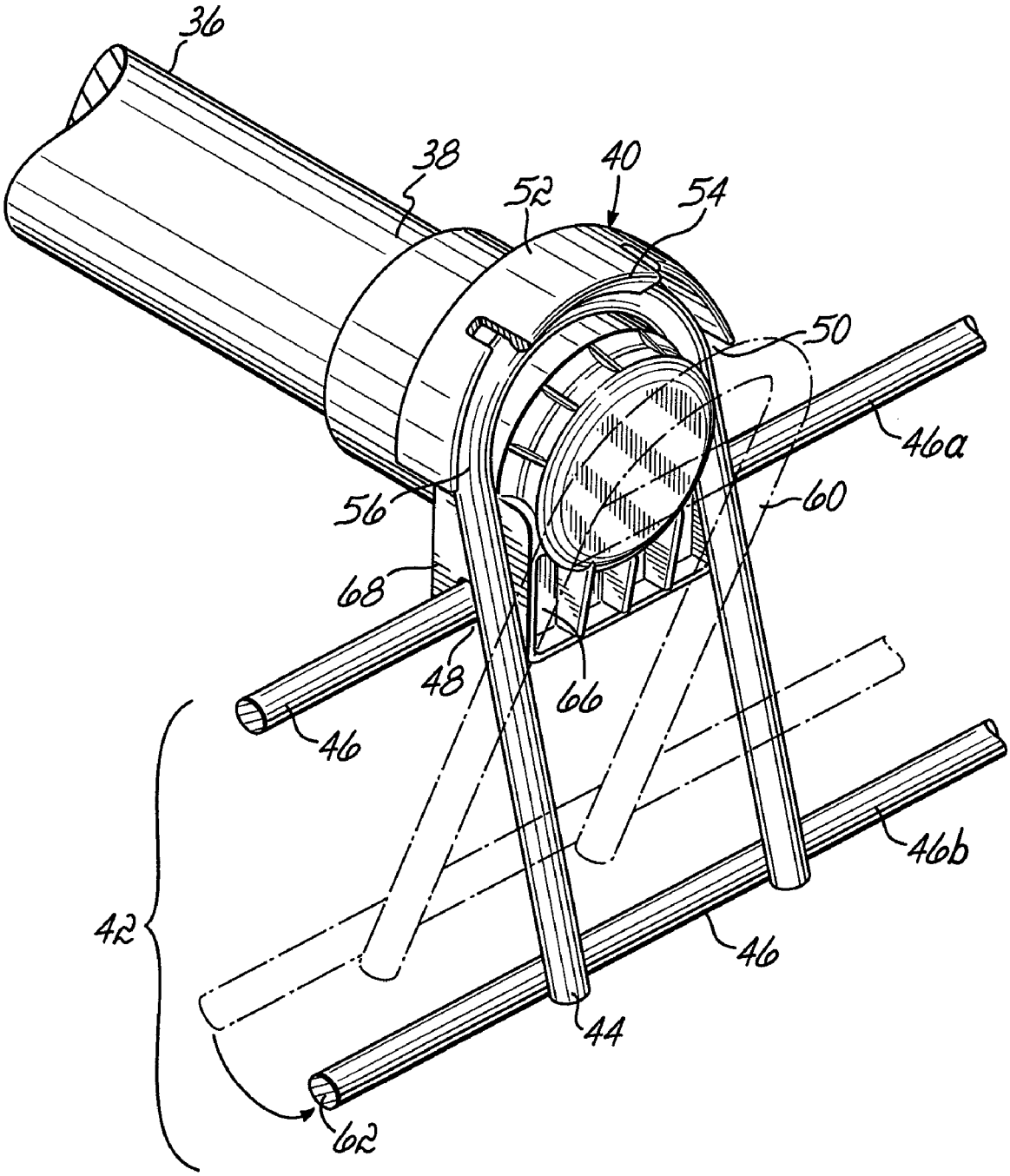
FIG. 2B is a perspective view of one end of the dowel bar assembly of FIG. 1, with the side frame coupled to the end cap of the assembly.

Referring now to FIG. 2B, the attachment of a side frame 42 to the end cap 40 is illustrated. FIG. 2B illustrates the side frame 42 in a first state 60 in phantom. In this first state 60 the upper cross wire 46*a* is inside of the channel 48. After the side frame 42 has been inserted into the channel 48 it can be rotated from the first state 60 illustrated in phantom to the second state 62 illustrated in solid. Upon rotating the side frame 42 around the pivot point created by the first channel 48 the curved portion 56 of the curved connection wire 44 is placed into the curved channel 50 and is lockingly engaged inside of the curved channel 50. To lock the curved portion 56, the resilient protrusion 54 first bends in an upward direction and then snap fits around the curved portion 56 of the curved connection wire 44. This configuration allows assembly of the dowel bar 36 and the side frame 42 prior to forming the concrete. The side frame 42 provides a stand for suspending the dowel bars 36 off of the ground so that they will be placed into the interior of a concrete slab.

Figure 3A:
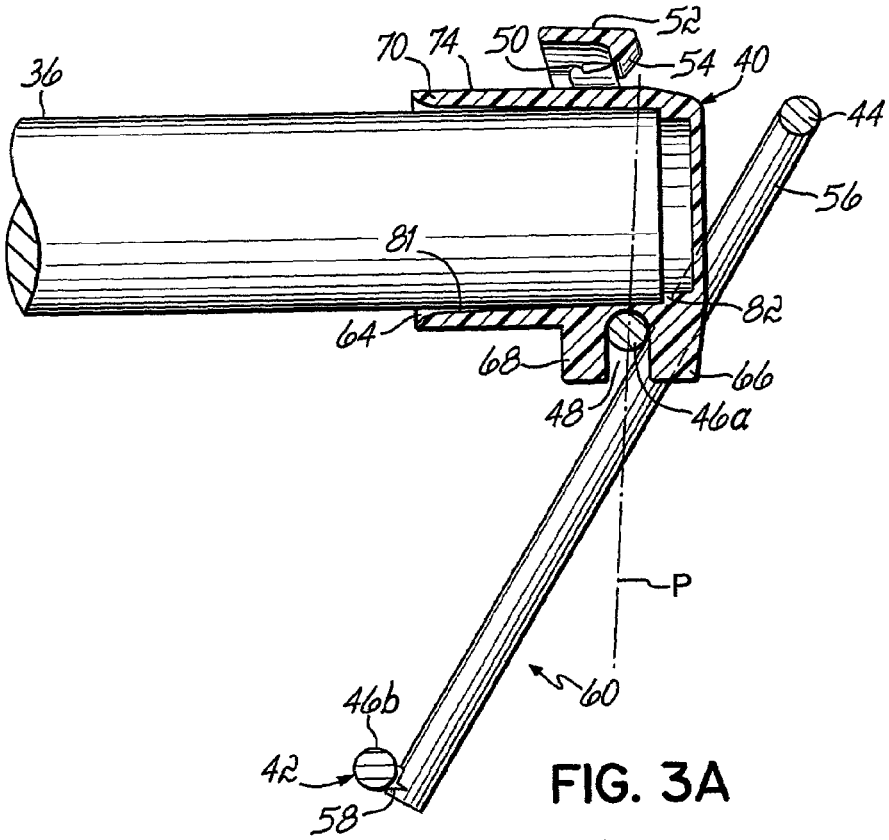
FIG. 3A is a cross-sectional side view of the end cap of the dowel bar assembly of FIG. 1, with the side frame partially coupled to the end cap.
Figure 3B:
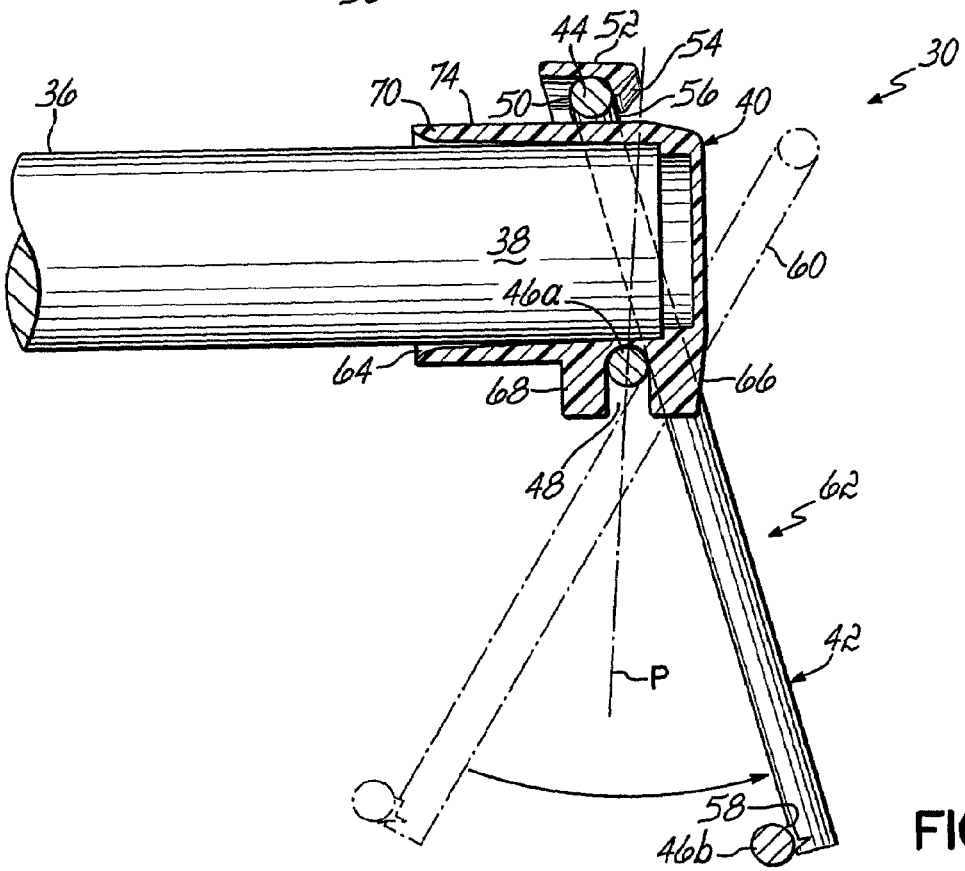
FIG. 3B is a cross-sectional side view of the end cap of the dowel bar assembly of FIG. 1, with the side frame completely coupled to the end cap.

Referring now to FIG. 3A, a cross-sectional view of the end cap 40 illustrates the first state 60 of the side frame 42. In this state, the channel 48 receives the cross wire 46*a* and the side frame 42 is positioned at an angle to a generally vertical plane P coincident with the longitudinal axis of the channel 48. The design of the channel 48 allows the cross wire 46*a* to rotate easily within the channel 48 so that the side frame 42 can be easily connected to the end cap 40. FIG. 3B illustrates the dowel bar assembly 30 after the side frame 42 has been moved to the second state 62. In this state, the side frame 42 has rotated around a pivot point created by the combination of the cross wire 46*a* and the channel 48. This places the curved portion 56 of the curved connection wire 44 into the curved channel 50 by deflecting the resilient protrusion 54 upwards to allow the curved portion 56 to slide into the curved channel 50. The resilient protrusion 54 is biased towards the interior of the end cap 40 and therefore locks down around the curved portion 56 of the curved connection wire 44 once it has been completely enclosed inside of the curved channel 50. Again, the position of the side frame 42 is at an angle to the plane P through the channel 48. This forms a stable base out of the side frame 42 for holding the dowel bars 36 steady while the concrete is being poured. Those skilled in the art will recognize that the side frame 42 can be positioned in a range of angles from the plane P depending on the orientation of the curved channel 50 and the end cap 40. FIGS. 3A and 3B also illustrate that the end cap 40 has an open end 64 that is designed to receive the dowel bar 36. In addition, FIGS. 3A and 3B illustrate that a first wall 66 and a second wall 68 define the channel 48. Those skilled in the art will recognize that channel 48 can be formed in different manners in different aspects of the dowel bar assembly.

Figure 4:
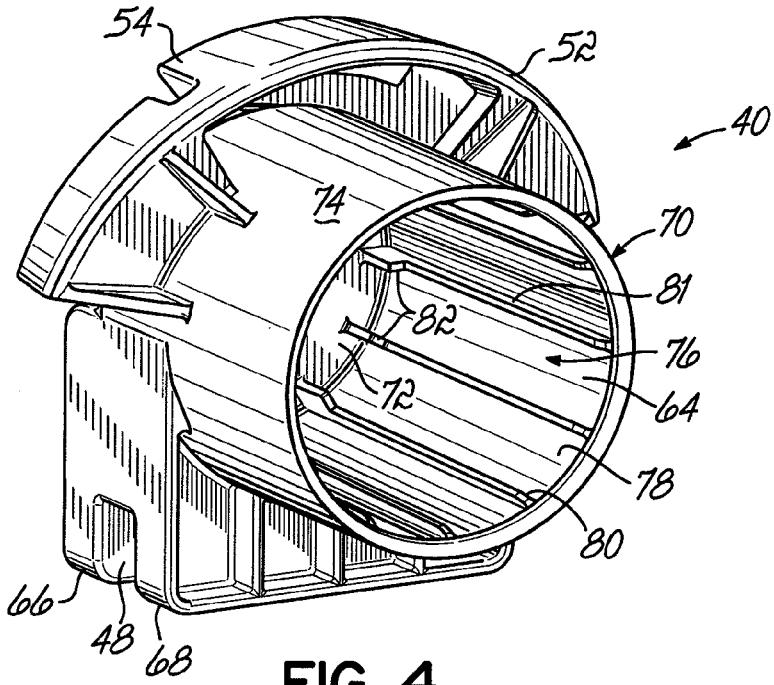
FIG. 4 is a rear perspective view of the end cap of the dowel bar assembly of FIG. 1.

FIG. 4 illustrates that the end cap 40 has a central portion 70 that includes a first end 72 for covering the end portion 38 of the dowel bar 36. The open end 64 receives the dowel bar 36 and an outer surface 74 surrounds the end portion 38 of the dowel bar 36 when inserted. The hood 52 substantially surrounds the first end 72 and defines the curved channel (not shown) generally around at least a portion of the periphery of the outer surface 74. The open end 64 of the central portion 70 of the end cap 40 provides access to a recessed area 76 defined by the inner surface 78 of the central portion 70. The inner surface 78 includes a plurality of ribs 80 around its periphery for facilitating a friction fit to the end portion 38 of the dowel bar 36 to snugly hold the end cap 40 in place. The ribs 80 have a first portion 81 that has a first height for engaging the outer surface of the dowel bar 36. The ribs 80 may also have a second portion 82 that has a second height greater than the first height for engaging the end portion 38 of the dowel bar 36 to limit the insertion of dowel bar 36 into the recessed area 76.

Figure 5:
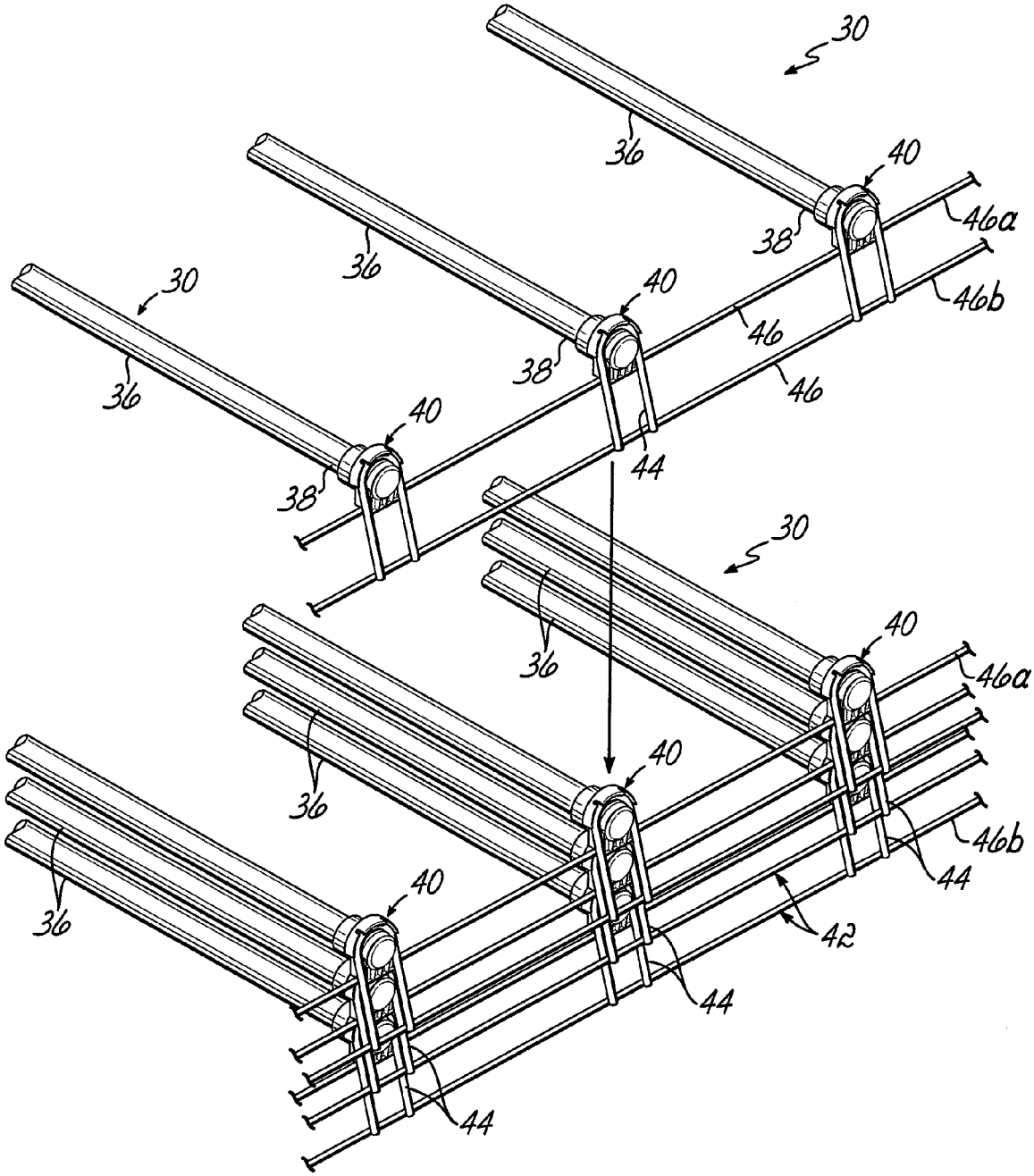
FIG. 5 depicts a plurality of dowel bar assemblies in a stacked arrangement.

Referring now to FIG. 5, a plurality of dowel bar assemblies 30 are shown stacked one upon each other. Therefore, the dowel bar assemblies 30 can be pre-assembled prior to shipment and conveniently stacked upon each other so to minimize the amount of space occupied, or assembled in one area of a construction site and stacked until needed.

Figure 6A:
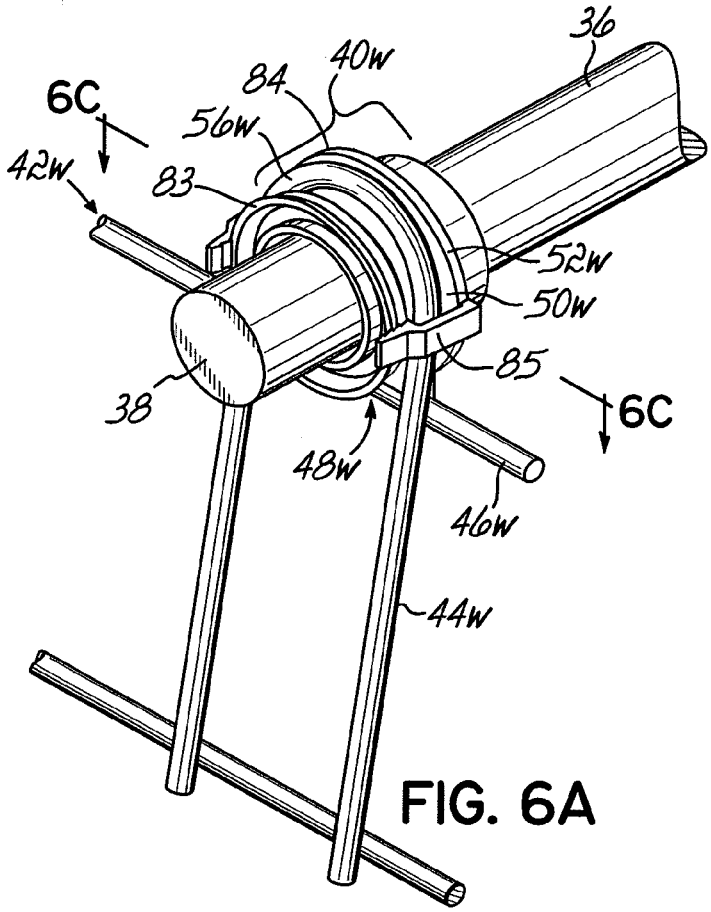
FIG. 6A is a perspective view of a first alternative aspect of a dowel bar assembly holding a side frame.
Figure 6B:
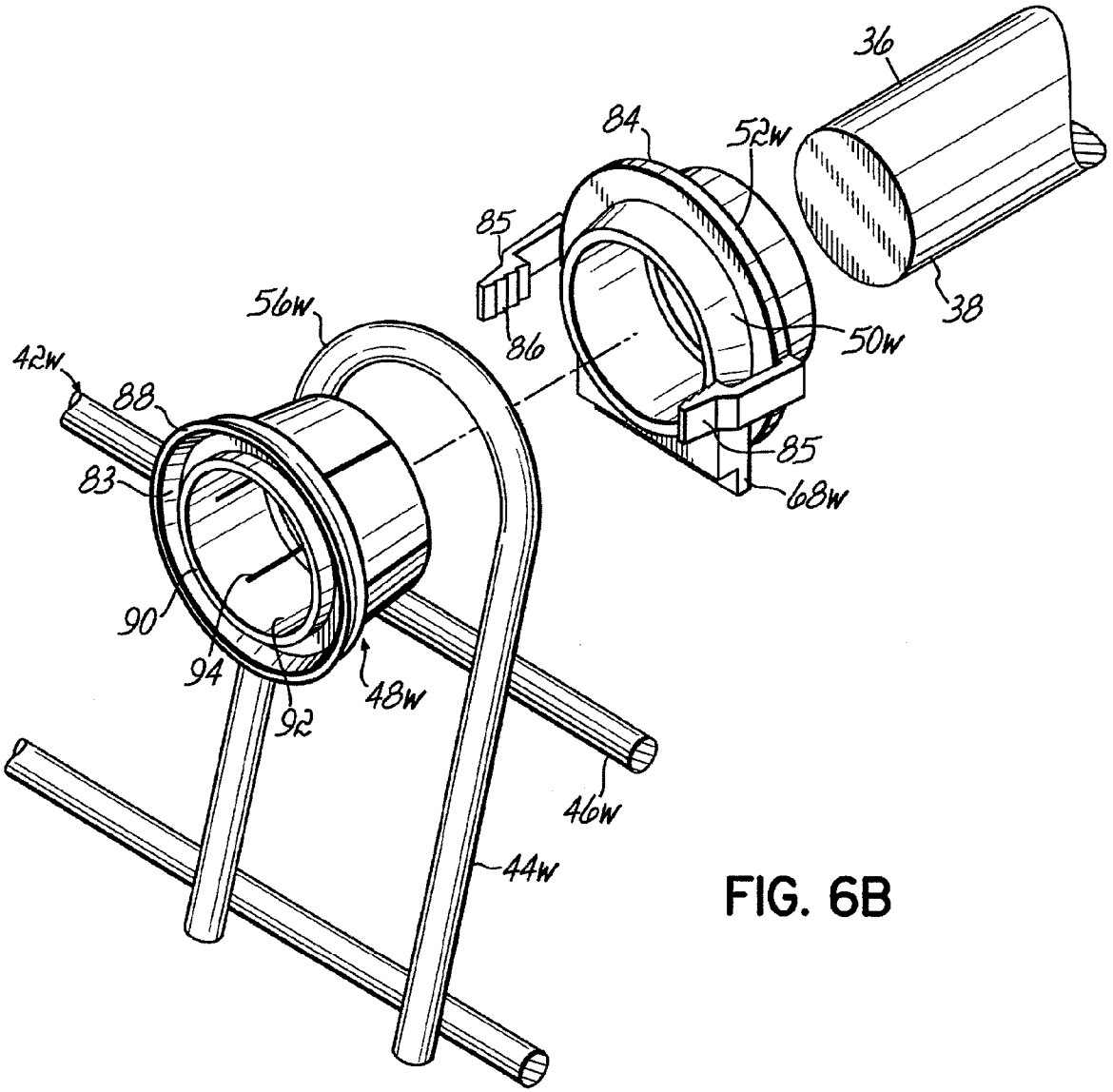
FIG. 6B is an exploded perspective view of the first alternate aspect of FIG. 6A.

Referring now to FIGS. 6A and 6B, one alternative aspect of an end cap 40W is illustrated. In FIGS. 6A and 6B identical reference numerals are used to described similar parts with the addition of a W suffix indicating that the parts are similar but slightly different as will be readily apparent from the figures. The end cap 40W includes a first section 83 that slides over the end portion 38 of the dowel bar 36. The first section 83 slides into contact with a second section 84 of the end cap 40W and locks with the second section 84 of the end cap 40W through the use of the dual resilient protrusions 85 on opposite sides of the dowel bar 36. The curved portion 56W of the curved connection wire 44W is restrained between the second section 84 and the first section 83. The end cap 40W, like end cap 40, has a hood 52W around the periphery of the outer surface of the end cap 40W that defines a curved channel 50W for receiving the curved portion 56W of the curved connection wire 44W. In addition, the end cap 40W has a channel 48W for receiving a cross wire 46W. Reference to FIG. 6B illustrates that the channel 48W is only bound by one wall 68W instead of two walls like in the end cap 40 of FIG. 4. FIG. 6B illustrates additional detail of the end cap 40W. The end cap 40W has the first section 83 that is lockingly engaged into place by the resilient protrusions 85 on either side of second section 84. The resilient protrusions 85 may include gripping ridges 86 that grip an outer portion 88 of the first section 83 and allow the first section 83 to be positioned in a plurality of locations longitudinally along the axis of the dowel bar 36. The inner portion 90 of the first section 83 has an interior surface 92 that defines ribs 94. Accordingly, when the second section 84 is slid over the end portion 38 of the dowel bar 36 the second section 84 can easily slide back and forth. Then when the curved connection wire 44W is desired to be connected to the end cap 40W, the curved connection wire 44W is slid over the end portion 38 of the dowel bar 36 and into the curved channel 50W of the second section 84. Then the first section 83 is slid over the end portion 38 of the dowel bar 36 and snapped into place using the resilient protrusions 85. Simultaneously, the ribs 94 of the first section 83 friction fit the first section 83 to the dowel bar 36 and keeps the entire end cap 40W and side frame 42W in stable connection with dowel bar 36. This design of the end cap 40W reduces the tolerances needed in the manufacture of the side frame 42W, lowering manufacturing costs and assisting assembly.

Figure 6C:
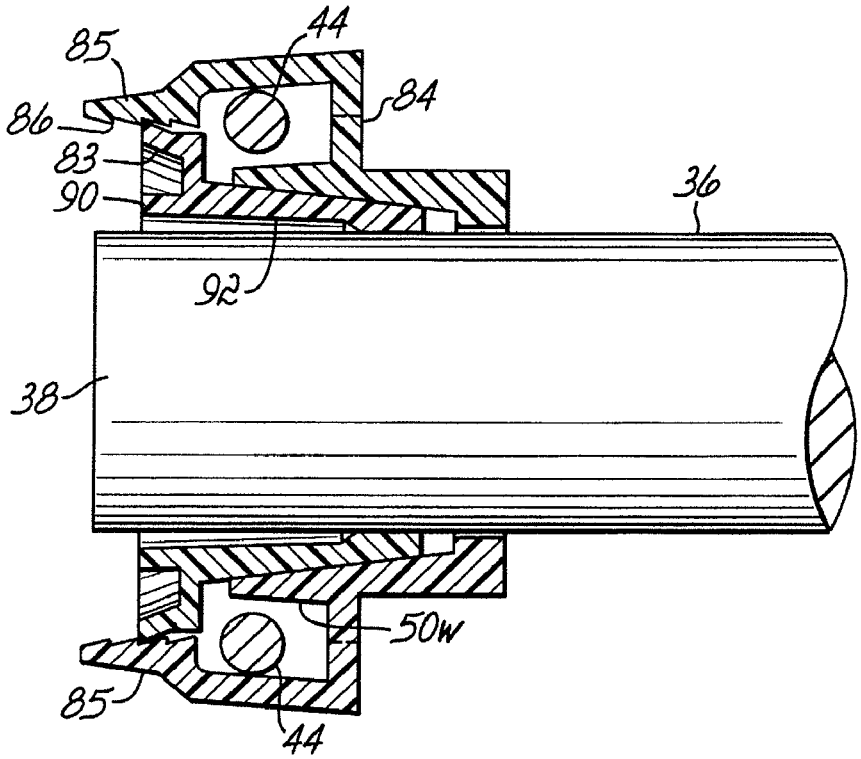
FIG. 6C is a cross-sectional side view of the end cap of the dowel bar assembly of FIG. 6A, with the side frame completely coupled to the end cap.

Referring now to FIG. 6C, a cross-sectional view of the end cap 40W illustrates how the first section 83 contacts the second section 84 of the end cap 40W and locks to the second section 84 through the dual resilient protrusions 85 on opposite sides of the dowel bar 36. Resilient protrusions 85 may include a series of gripping ridges 86 that grip an outer portion of the first section 83 and allow the first section 83 to be positioned in a plurality of locations longitudinally along the axis of the dowel bar 36. Second section 84 may compress first section 83 as first section 83 is positioned more closely to second section 84 along the axis of the dowel bar 36, enhancing the friction fit of the first section 83 to the dowel bar 36. Resilient protrusions 85 may also be manually disengaged from first section 83 to permit end cap 40W to be repositioned or otherwise removed as necessary.

Figure 6D:
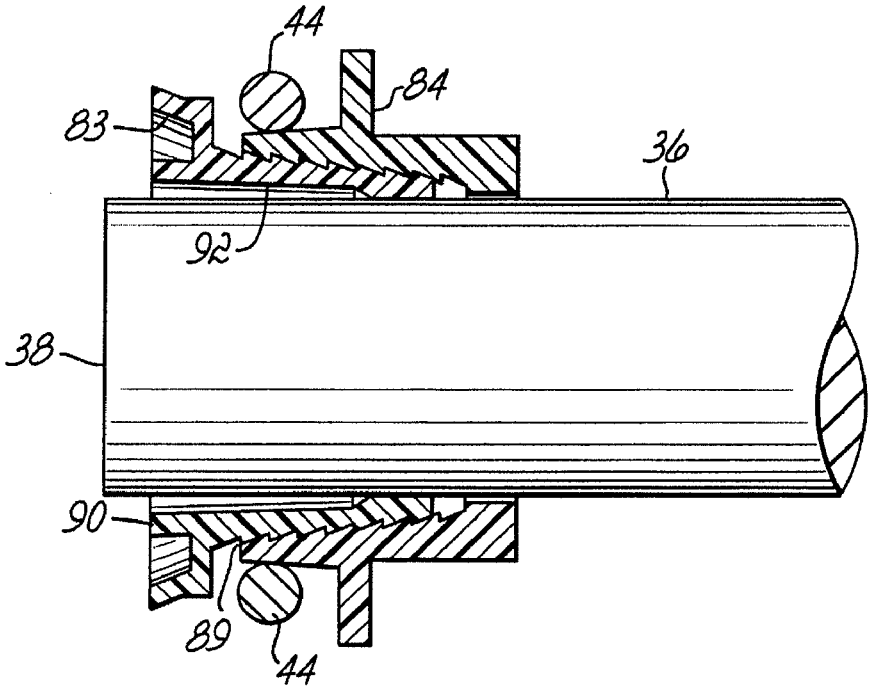
FIG. 6D is a cross-sectional side view of a variant of the end cap of the dowel bar assembly of FIG. 6A, with the side frame completely coupled to the end cap.

Referring now to FIG. 6D, a cross-sectional view of a variant of the end cap 40W illustrates how the first section 83 may contact the second section 84 of the end cap 40W and lock to the second section 84 without the use of resilient protrusions. A portion of the inside surface of second section 84 and a portion of the outside surface of first section 83 may be formed with complementary gripping ridges 89 that are brought into mutual engagement when the first section 83 is slid into contact with the second section 84. Second section 84 may compress first section 83 as first section 83 is advanced toward second section 84 along the axis of the dowel bar 36, enhancing the friction fit of the first section 83 to the dowel bar 36. The positioning of gripping ridges 89 on complementary surfaces of the first section 83 and the second section 84 additionally shields the connection and provides an effective one-way locking mechanism.

Figure 7:
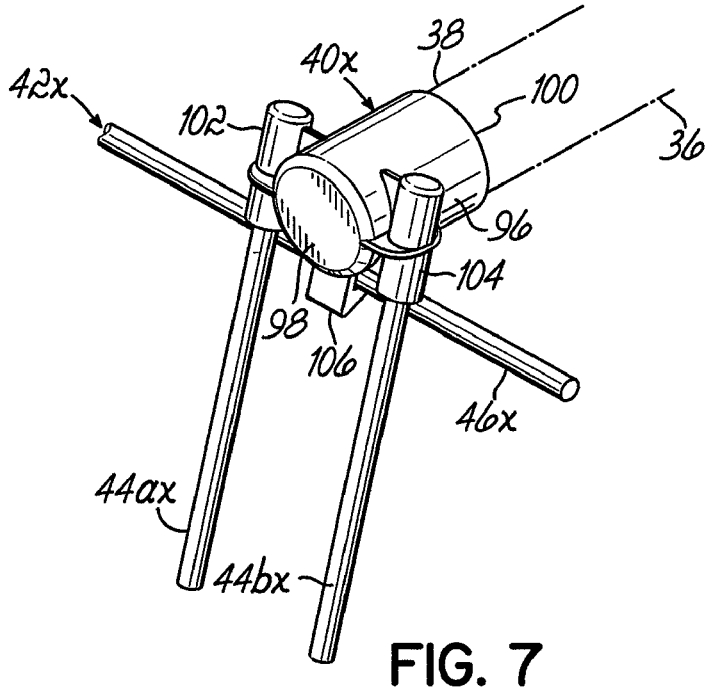
FIG. 7 is a perspective view of an end cap for a second alternative aspect of a dowel bar assembly.

Referring now to FIG. 7, another alternative aspect of an end cap 40X is illustrated. Once again, similar parts are designated with identical reference characters with the addition of the X symbol to indicate that the parts are similar to the reference characters already used with readily apparent differences. The end cap 40X includes a central portion 96 having a first end 98 that is closed and a second end 100 that is open. The second end 100 is designed to be able to receive the end portion 38 of the dowel bar 36. The end cap 40X includes a first sleeve 102 for receiving a first connection wire 44*a*X and a second sleeve 104 that for receiving a second connection wire 44*b*X. In the illustrated aspect, the first sleeve 102 and second sleeve 104 are integrally formed with the central portion 96 of the end cap 40X. Those skilled in the art, however, recognize that in other aspects the sleeves can be coupled to the central portion 96 in other manners. The second sleeve 104 is positioned along a tangent of the dowel bar 36 and the first sleeve 102 is positioned along an opposite tangent of the dowel bar 36 that arranges the connection wires 44*a*X and 44*b*X substantially parallel to one another. In addition, the central portion 96 also has a resilient protrusion 106 for coupling to the cross wire 46X. The cross wire 46X and the connection wires 44*a*X and 44*b*X are pre-welded together to form side frame 42X so that assembly is simple. The end cap 40X is simply placed over the end portion 38 of the dowel bar 36 and then the connection wires 44*a*X and 44*b*X are slid into the first and second sleeve 102, 104. Next, the resilient protrusion 106 is clipped around the cross wire 46X.

Figure 8:
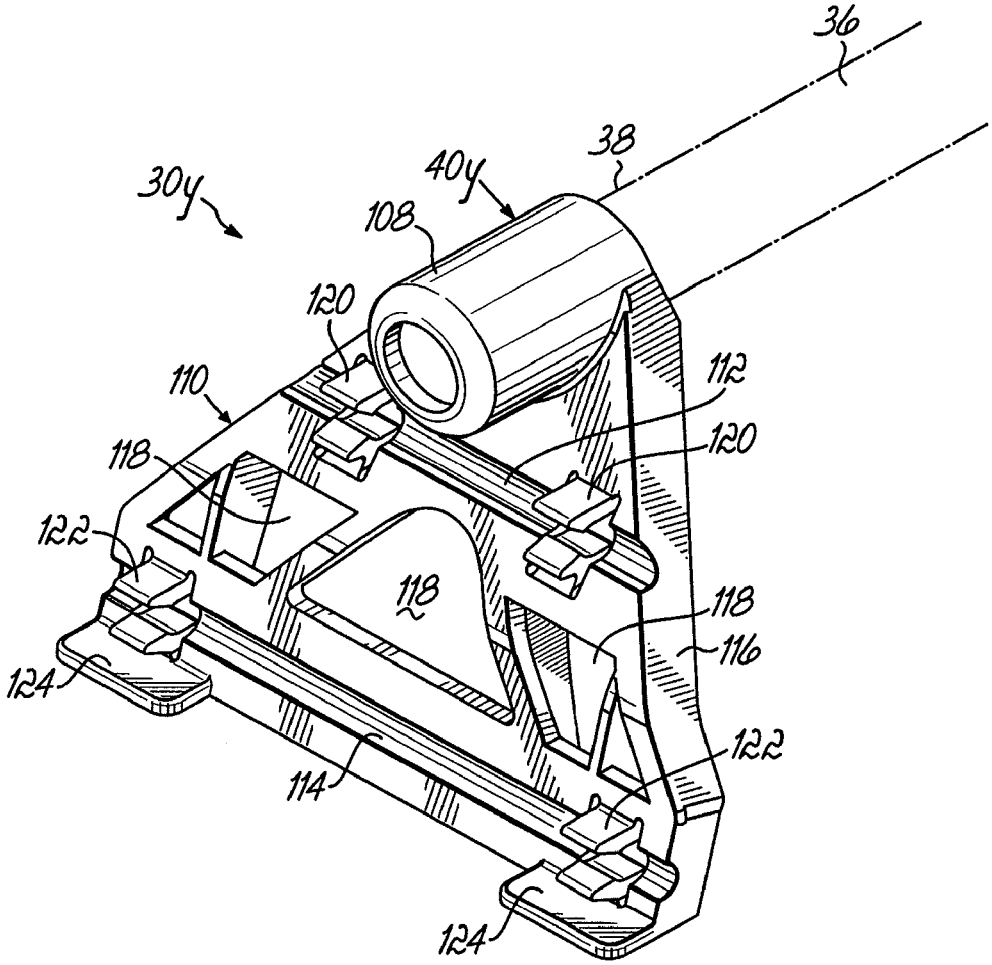
FIG. 8 is a perspective view of an end cap for a third alternative aspect of a dowel bar assembly.
Figure 9A:
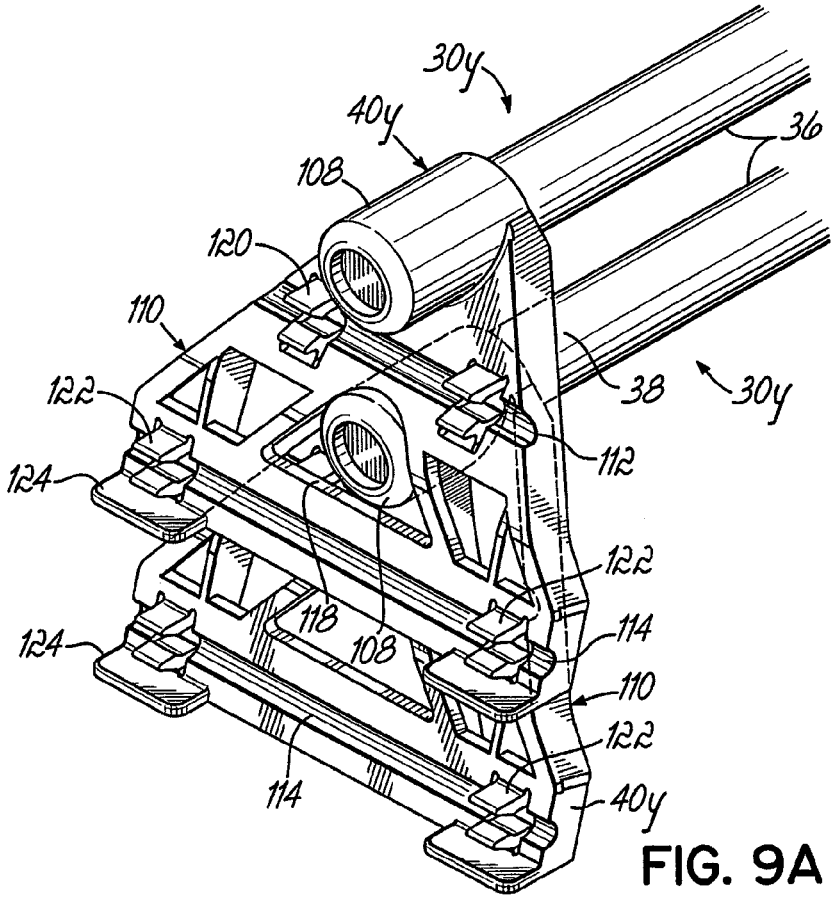
FIG. 9A depicts a plurality of dowel bar assemblies having the end caps of FIG. 8 stacked upon each other.
Figure 9B:
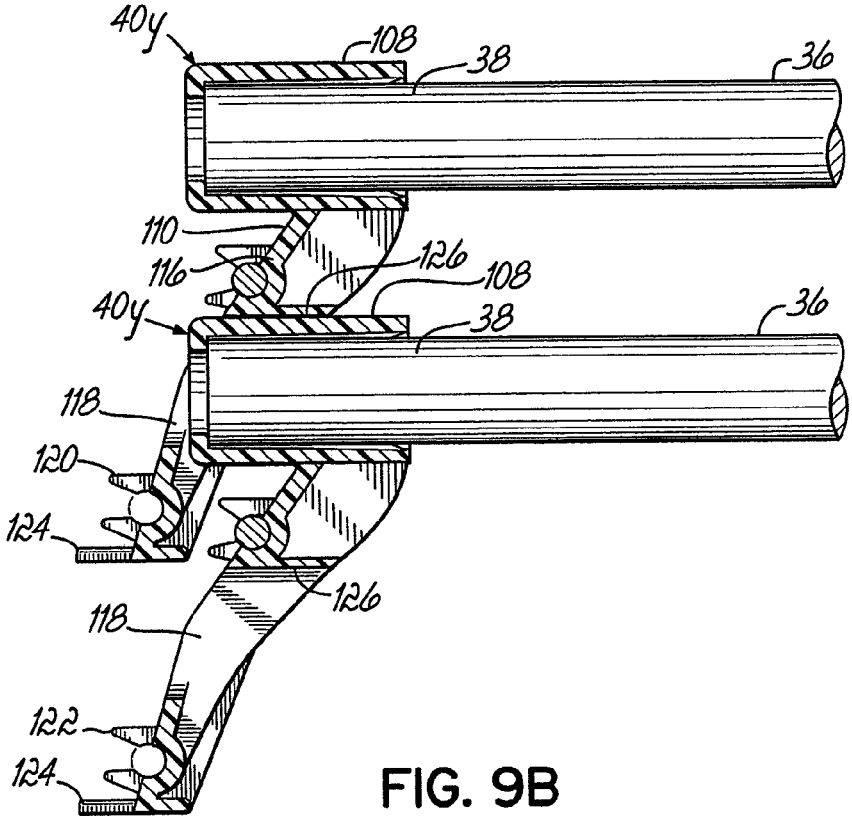
FIG. 9B is a cross-sectional side view of the stacked dowel bar assemblies of FIG. 9A.

Referring now to FIG. 8, another alternative aspect of an end cap 40Y is illustrated. Once again, similar parts are designated with identical reference characters with the addition of the Y symbol to indicate that the parts are similar to the reference characters already used with readily apparent differences. The end cap 40Y includes a connecting portion 108 that is designed to form an interior area for receiving an end portion 38 of the dowel bar 36. In addition, the end cap 40Y includes a supporting portion 110 that is integrally formed with the connecting portion 108. The supporting portion 110 supports the side frame (not shown). The supporting portion 110 has a first wire support 112 and a second wire support 114 formed therein. In the illustrated aspect, the wire supports 112, 114 are channels formed in the supporting portion, however, in other aspects of the dowel bar assembly other structures are used. The wire supports 112, 114 lie within the apron 116 of the end cap 40Y. The apron 116 includes a plurality of apertures 118 designed to lighten the weight of the supporting portion 110, to allow concrete to easily flow therethrough, and to assist with stacking the dowel bar assemblies 30Y as illustrated in FIGS. 9A and 9B. In the illustration, the first wire support 112 includes two clamp pairs 120 arranged substantially parallel to each other that are designed to clamp around a portion of the side frame (not shown), such as a cross wire (not shown). Each clamp pair may be formed of resiliently opposed clamping members, however, other aspects may use other structure to clamp around a portion of the side frame. In addition, the second wire support 114 may also include two claim pairs 112 which are also designed to clamp around a portion of the side frame (not shown). The supporting portion 110 may also include base members 124 designed to support the entire dowel bar assembly 30Y upon the ground surface prior to the pouring of the concrete. The end cap 40Y eliminates the need to have connection wires (not shown) having a curved portion and simply allows the dowel bar 36 to be connected to a cross wire (not shown).

Referring now to FIG. 9A, the stackability of the dowel bar assembly 30Y is illustrated. FIG. 9A illustrates that one supporting portion 110 rests on top of another dowel supporting portion 110 and the connecting portion 108 of one dowel bar assembly 30Y passes through the largest one of the apertures 118 of another dowel bar assembly 30Y.

Referring now to FIG. 9B, a cross-sectional view provides additional detail of the stacking illustrated in FIG. 9A. This view illustrates clearly that the connecting portion 108 extends through an aperture 118 and supports the apron 116 along a support surface 126. Therefore, in some situations it is preferable to pre-assemble the dowel bar assembly 30Y prior to shipping to the construction site. The stackability of these dowel bar assemblies 30Y facilitates ease in transporting these dowel bar assemblies 30Y.

Figure 10:
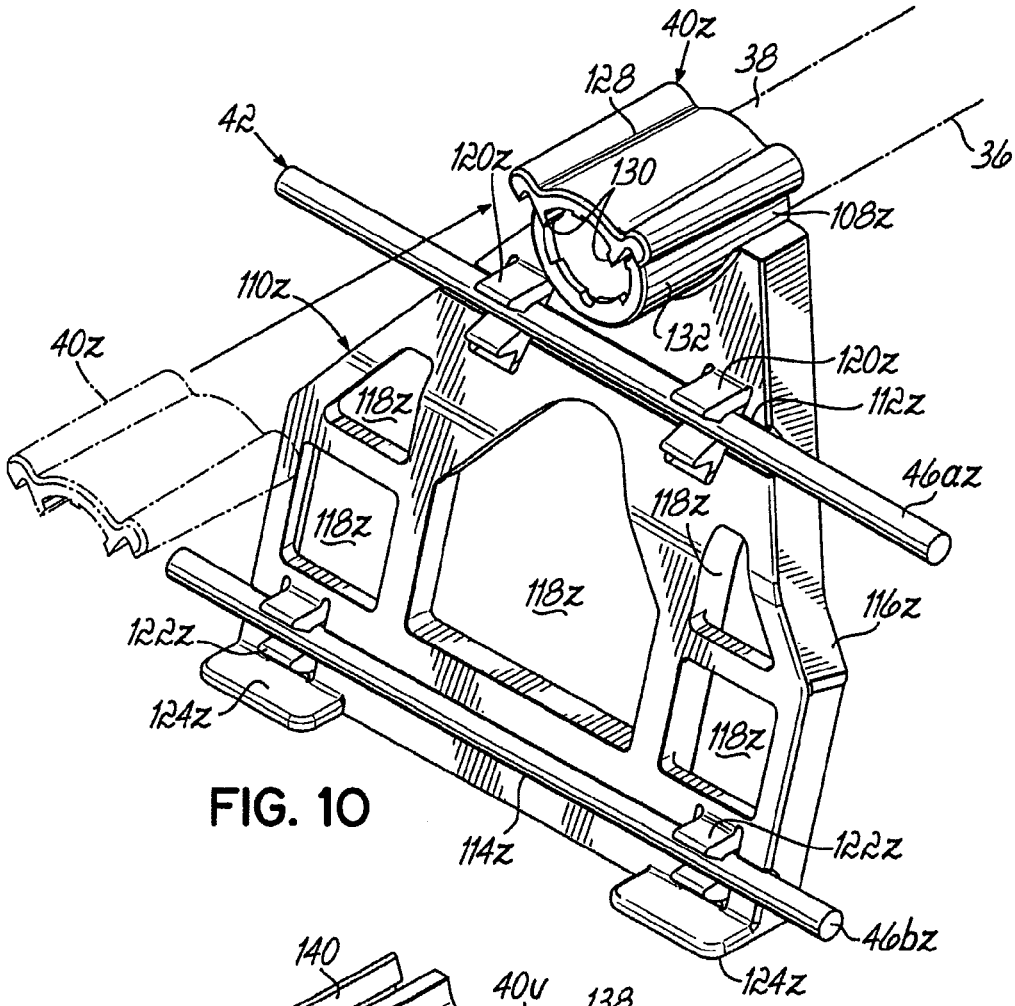
FIG. 10 is a perspective view of an end cap for a fourth alternative aspect of a dowel bar assembly.

Referring now to FIG. 10, an alternative aspect of an end cap 40Z is illustrated. As in the earlier aspects, like numerals are used to refer to like parts and similar parts are designated with a Z symbol. The end cap 40Z includes a removable top 128 that includes guide rails 130 that help it to slidingly engage the bottom portion 132 of the connecting portion 108Z. This design allows an end portion 38 of a dowel bar 36 to be inserted into the connecting portion 108Z. Then the end cap 40Z can be snugly attached to the end portion 38 of the dowel bar 36 by sliding the top portion 128 so that the guide rails 130 interact with the bottom portion 132 to snap the top portion 128 over the dowel bar 36. Like in the aspect shown in FIG. 8, the end cap 40Z includes a supporting portion 110Z that includes a first wire support 112Z and a second wire support 114Z arranged substantially parallel to each other. These wire supports 112Z, 114Z each include their own respective pars of clamps 120Z and 122Z. In addition, they also include the base members 124Z and an apron 116Z to connect all of the pieces together. Accordingly, the cross wires 46*a*Z, 46*b*Z are coupled to the supporting portion 110Z and the dowel bar 36 is connected to the connecting portion 108Z to create the assembly.

Figure 11:
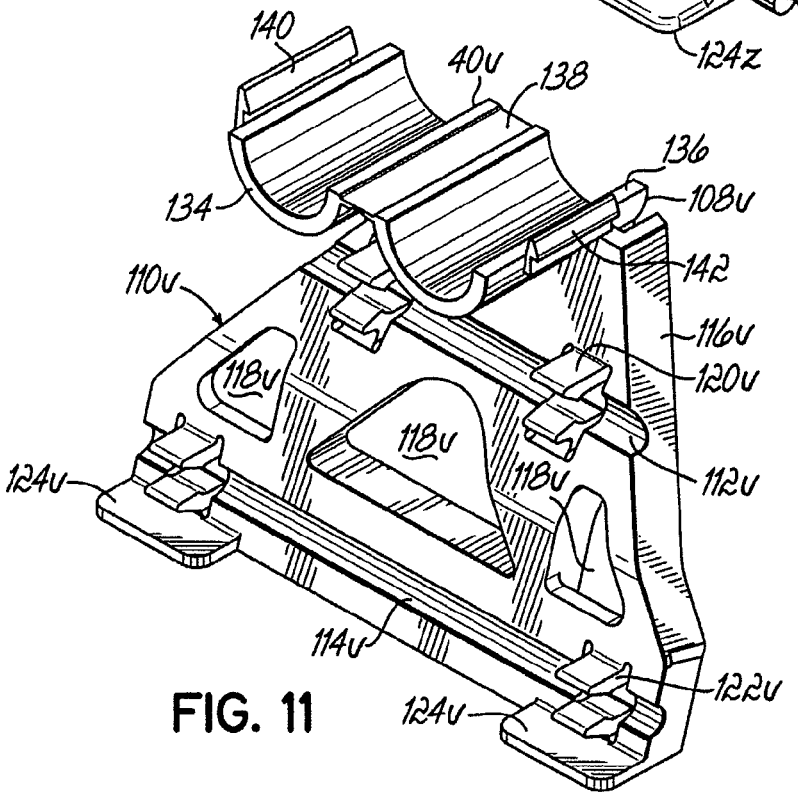
FIG. 11 is a perspective view of an end cap for a fifth alternative aspect of a dowel bar assembly.

Referring now to FIG. 11, an alternative aspect of an end cap 40V is illustrated. As in the earlier aspects, like numerals are used to refer to like parts and similar parts are designated with a V symbol. As in FIG. 10, this aspect has a connecting portion 108V and a supporting portion 110V, however, the design of the connecting portion 108V is different. The connecting portion 108V includes an upper half 134 and a lower half 136 for surrounding the dowel bar 36 received in the lower half 136. In the illustrated aspect, the halves 134, 136 are clasps, however those skilled in the art will recognize that other structures are used in other aspects of the dowel bar assembly. The upper half 134 and the lower half 136 are joined together using a living hinge 138. A living hinge 138 is used in the illustrated aspect, however, those skilled in the art will recognize that other types of hinge mechanisms for connecting the upper half 134 to the lower half 136 can be used in other aspects. The living hinge 138 allows the first tab 140 of the upper half 134 to lockingly engage with the second tab 142 of the lower half 136. Accordingly, the upper half 134 locks around the end portion 38 of the dowel bar 36 when the dowel bar 36 is received by the lower half 136. Similarly, like the other aspects shown in FIGS. 8 and 10, the supporting portion 110V includes a first wire support 112V and a second wire support 114V arranged substantially parallel. In addition, the end cap 40V also includes first clamp members 120V and second clamp members 122V. Also, a set of apertures 118V and base members 124V may be used with the apron 116V to form the supporting member 110V.

This has been a description of the present invention and one preferred mode of practicing the invention, however, the invention itself should only be defined by the appended claims.

What is claimed is:

1. An end cap for connecting a side frame having a first cross wire and a second cross wire to a dowel comprising:

a receiving portion defining an interior area for receiving an end of said dowel; and a supporting portion integrally formed with said receiving portion for supporting said side frame, the supporting portion including a first wire support for supporting said first cross wire and a second wire support for supporting said second cross wire, wherein the first and second wire supports are arranged substantially parallel to each other.

2. The end cap of claim 1, wherein said receiving portion includes a first clasp and a second clasp, and wherein said first clasp snap fits to said second clasp around said end of said dowel.

3. The end cap of claim 2, wherein said first clasp and said second clasp are interconnected by a living hinge.

4. The end cap of claim 1, wherein said receiving portion includes a removable top portion that slides over said end of said dowel.

5. The end cap of claim 1, wherein said receiving portion includes protrusions extending inwardly from the periphery of said receiving portion adjacent said interior area for frictionally engaging said end of said dowel.

6. The end cap of claim 1, wherein said first and second wire supports include resilient opposed clamps for snap fitting said side frame to said end cap.

7. The end cap of claim 1, wherein said first wire support and said second wire support are channels defined in said supporting portion.

8. An end cap for connecting a dowel to a side frame comprising:

a tubular central portion including a first end and a second end, wherein at least one of said ends is an open end for receiving said dowel and said tubular central portion defines an outer peripheral surface;

a first sleeve coupled to said central portion and positioned along a first tangent of said outer peripheral surface of said tubular central portion for receiving a portion of the side frame;

a second sleeve coupled to said central portion and positioned along a second tangent of said outer peripheral surface of said tubular central portion for receiving a different portion of the side frame, wherein said second tangent is on an opposite side of said outer peripheral surface of said tubular central portion from said first tangent; and a resilient protrusion coupled to said central portion for receiving a further differing portion of said side frame.

9. The end cap of claim 8 wherein said first sleeve and said second sleeve are integrally formed with said central portion.

* * * * *